US008360617B2

(12) United States Patent
Gillies et al.

(10) Patent No.: US 8,360,617 B2
(45) Date of Patent: Jan. 29, 2013

(54) LIGHTING SYSTEM INCLUDING LED WITH GLASS-COATED QUANTUM-DOTS

(75) Inventors: Jennifer Gillies, Cambridge, MA (US); Wei Liu, Schenectady, NY (US); David Socha, Glenmont, NY (US)

(73) Assignee: Samsung Electronics Co., Ltd. (KR)

( * ) Notice: Subject to any disclaimer, the term of this patent is extended or adjusted under 35 U.S.C. 154(b) by 367 days.

(21) Appl. No.: 12/625,727

(22) Filed: Nov. 25, 2009

(65) Prior Publication Data

US 2010/0177496 A1 Jul. 15, 2010

Related U.S. Application Data

(60) Provisional application No. 61/117,932, filed on Nov. 25, 2008.

(51) Int. Cl.
*F21V 3/04* (2006.01)
*H01R 33/05* (2006.01)

(52) U.S. Cl. ..... 362/311.02; 362/311.03; 362/217.08; 362/650; 362/249.02; 257/98; 257/100

(58) Field of Classification Search ..... 362/311.02, 362/311.03, 217.08, 249.02, 351, 355, 650; 257/98, 100
See application file for complete search history.

(56) References Cited

U.S. PATENT DOCUMENTS 4,992,704 A * 2/1991 Stinson ..... 315/324
5,688,042 A * 11/1997 Madadi et al. ..... 362/240
5,924,784 A * 7/1999 Chliwnyj et al. ..... 315/324
6,149,283 A * 11/2000 Conway et al. ..... 362/236
6,746,885 B2 * 6/2004 Cao ..... 438/26
6,803,719 B1 10/2004 Miller et al.
6,864,626 B1 3/2005 Weiss et al.
7,083,490 B2 * 8/2006 Mueller et al. ..... 445/24
7,102,152 B2 * 9/2006 Chua et al. ..... 257/14
7,116,485 B2 10/2006 Po-Hung et al.
7,245,072 B2 * 7/2007 Ouderkirk et al. ..... 313/502
7,246,919 B2 * 7/2007 Porchia et al. ..... 362/276
7,507,354 B2 * 3/2009 Oshio ..... 252/301.4 F
7,518,160 B2 * 4/2009 Fukudome et al. ..... 257/98
7,655,486 B2 * 2/2010 Thompson et al. ..... 438/25
2006/0014040 A1 1/2006 Peng et al.
2006/0158881 A1 7/2006 Dowling
2006/0245710 A1 11/2006 Borrelli et al.
2007/0267976 A1 11/2007 Bohler et al.
2008/0105887 A1 5/2008 Narendran et al.
2008/0173886 A1 * 7/2008 Cheon et al. ..... 257/98

FOREIGN PATENT DOCUMENTS

WO WO 2007002234 A1 * 1/2007

* cited by examiner

*Primary Examiner* — Ismael Negron
(74) *Attorney, Agent, or Firm* — Cantor Colburn LLP

(57) ABSTRACT

A lighting system includes at least one light emitting diode and a coating of matrix material having at least one glass-coated quantum dot in a base material. The at least one glass-coated quantum dot may be selected from at least one of a group II-VI materials, III-V materials, IV-VI materials, I-III-VI materials and combinations of such materials. The matrix material may be silicone, and the lighting system may include a light bulb replacement fixture including a threaded screw electrically connected to the light emitting diode.

9 Claims, 2 Drawing Sheets

Normalized QD Power = QD Power/Total Power
Equation of line from 72 Hours----->768 Hours = y = -0.000088096x + 0.621784319
Extrapolation Halflife Calculation = -((0.62/2)-0.621784319)/0.000088096 = 3539 Hours

| | Burn-in period | | Graphed Data | | |
|---|---|---|---|---|---|
| Hours | 0 | 72 | 240 | 432 | 768 |
| Days | 0 | 3 | 10 | 18 | 32 |
| Date | 7/10/2009 | 7/13/2009 | 7/20/2009 | 7/28/2009 | 8/11/2009 |
| Normalized QD Power | 62.68% | 62.09% | 59.04% | 58.65% | 55.41% |

Projected Halflife (Usable Lifetime) = 3539 Hours

LIGHTING SYSTEM INCLUDING LED WITH GLASS-COATED QUANTUM-DOTS

CROSS-REFERENCE TO RELATED APPLICATIONS

This application claims the benefit of U.S. Provisional Application No. 61/117,932, filed 25 Nov. 2008, and U.S. application Ser. No. 12/579,829, filed 15 Oct. 2009, each of which is hereby incorporated herein.

TECHNICAL FIELD

The present invention relates to light emitting diodes (LEDs) comprising semiconductor nanocrystals, or more specifically quantum dots, used as a stable phosphor.

BACKGROUND OF THE INVENTION

Light emitting diodes (LEDs) have become a desirable replacement for traditional lighting methods, including incandescent, fluorescent and halogen lighting. Compared to these types of lights, LEDs are much more energy efficient and may have much longer product lifetimes. However, the materials used to make LEDs typically limit the colors possible in an LED lighting application.

Semiconductor nanocrystals are typically tiny crystals of II-VI, III-V, IV-VI, or I-III-VI materials that have a diameter between 1 nanometer (nm) and 20 nm. In the strong confinement limit, the physical diameter of the nanocrystal is smaller than the bulk excitation Bohr radius causing quantum confinement effects to predominate. In this regime, the nanocrystal is a 0-dimensional system that has both quantized density and energy of electronic states where the actual energy and energy differences between electronic states are a function of both the nanocrystal composition and physical size. Larger nanocrystals have more closely spaced energy states and smaller nanocrystals have the reverse. Because interaction of light and matter is determined by the density and energy of electronic states, many of the optical and electric properties of nanocrystals can be tuned or altered simply by changing the nanocrystal geometry (i.e. physical size).

Single nanocrystals or monodisperse populations of nanocrystals exhibit unique optical properties that are size tunable. Both the onset of absorption and the photoluminescent wavelength are a function of nanocrystal size and composition. The nanocrystals will absorb all wavelengths shorter than the absorption onset, however, photoluminescence will always occur at the absorption onset. The bandwidth of the photoluminescent spectra is due to both homogeneous and inhomogeneous broadening mechanisms. Homogeneous mechanisms include temperature dependent Doppler broadening and broadening due to the Heisenberg uncertainty principle, while inhomogeneous broadening is due to the size distribution of the nanocrystals. The narrower the size distribution of the nanocrystals is, the narrower the full-width at half max (FWHM) of the resultant photoluminescent spectra will be. In 1991, Brus wrote a paper reviewing the theoretical and experimental research conducted on colloidally grown semiconductor nanocrystals, such as cadmium selenide (CdSe) in particular. (Brus L., Quantum Crystallites and Nonlinear Optics, *Applied Physics A,* 53 (1991)). That research, precipitated in the early 1980's by the likes of Efros, Ekimov, and Brus himself, greatly accelerated by the end of the 1980's as demonstrated by the increase in the number of papers concerning colloidally grown semiconductor nanocrystals in past years.

Although nanocrystal based LEDs have been developed and commercialized to date by Evident Technologies, the relative lifetime of these LEDs has generally been limited to less than 1000 hrs. Relative LED lifetime is typically measured by comparing the total power output after a burn in period to the time required to achieve a total power output at 50% of the original signal. This shorter lifetime is primarily due to the sensitivity of the semiconductor nanocrystals to water, oxygen, light, and heat. As a result it is desired to increase the LED lifetime in order to enable high margin business and more general lighting applications.

SUMMARY OF THE INVENTION

The present invention describes single, binary and ternary mixtures of luminescent QDs and methods of treating them and configuring them by applying them to underlying LED sources in order to achieve specialty color and specialty white LEDs with a lifetime of greater than 1000 hrs with a preference to greater than 5000 hrs.

A first aspect includes a system comprising: at least one light emitting diode; and a matrix material containing at least one quantum dot comprising a coating that is at least one of the following: on the at least one light emitting diode or above the at least one light emitting diode.

A second aspect includes a method of forming a glass coating on at least one quantum dot, the method comprising: adding to a solution containing a quantity of quantum dots a quantity of APS; adding to the solution a quantity of TEOS; and drying the solution to yield a quantity of glass-coated quantum dots.

The semiconductor nanocrystals, or quantum dots more specifically, useful in the present invention are described in the commonly-owned application Ser. Nos. 11/125,120 and 11/125,129. These quantum dots comprise a core semiconductor with a thin metal layer to protect from oxidation and to aid lattice matching, and a shell to enhance the luminescent properties, especially for the II-VI or III-V materials. Non-limiting examples of semiconductor nanocrystal cores include ZnS, ZnSe, ZnTe, CdS, CdSe, CdTe, HgS, HgSe, HgTe (II-VI materials), PbS, PbSe, PbTe (IV-VI materials), AlN, AlP, AlAs, AlSb, GaN, GaP, GaAs, GaSb, InN, InP, InAs, InSb, InGaP (III-V materials), $CuInGaS_2$, $CuInGaSe_2$, $AgInS_2$, $AgInSe_2$, and $AuGaTe_2$ (I-III-VI materials). The metal layer is often formed of Zn or Cd, and the shell may be of the same material as the core or any of the above listed core materials.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
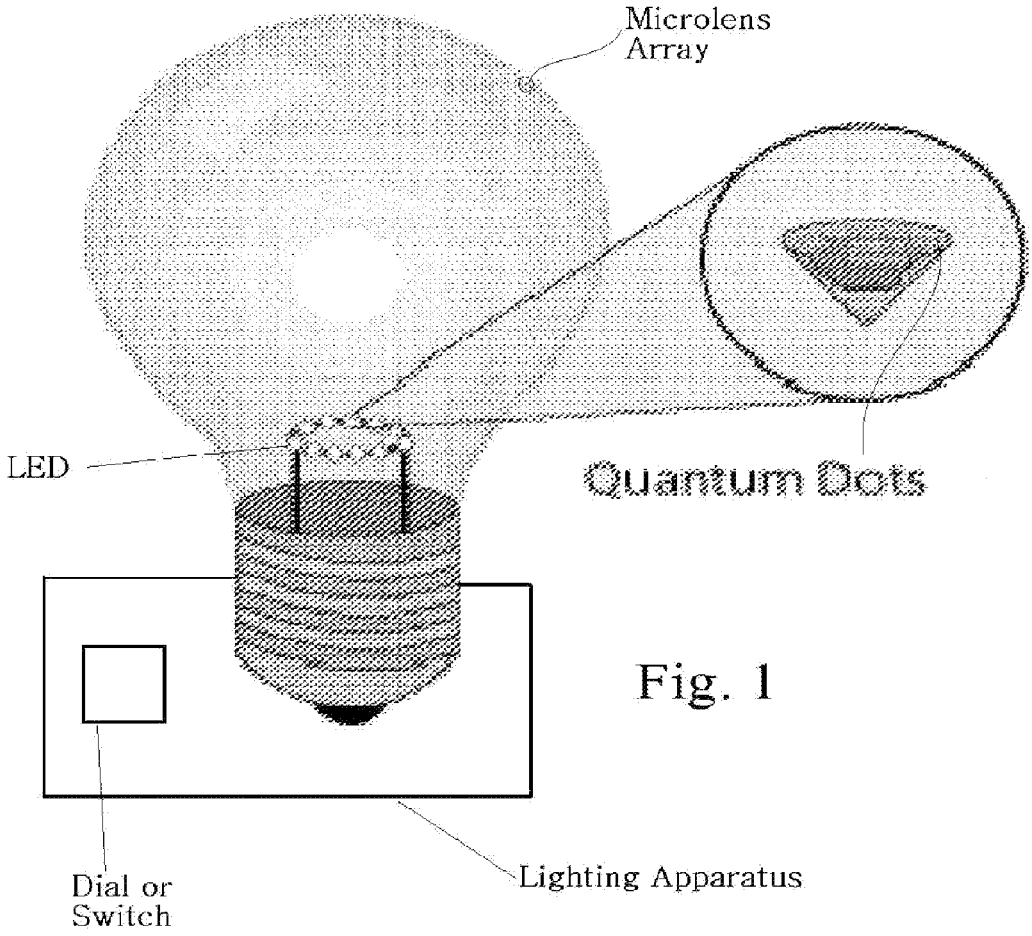
FIG. 1 shows an illustration of a glass coated quantum dots within a silicone matrix placed on top of an LED chip according to an embodiment of the invention.
Figure 2:
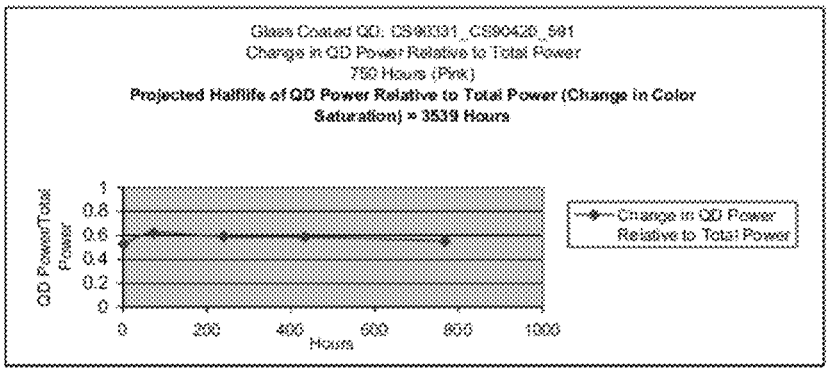
FIG. 2 shows the longevity of a glass coated nanocrystal phosphor layer taken in silicone.

A system is presented comprising a coated semiconductor nanocrystal based LED system. It is understood that this may include any coating, matrix material, or lens cap material now known or later developed wherein the lifetime of the LED is above 5,000 hours. This may include but is not limited to any matrix material which may be deposited into the LED cup, or any material which may be used to surround or encase the semiconductor nanocrystals, or any material which may be used as a lens cap for an LED, providing the material enables the semiconductor nanocrystal based LED system to have a lifetime of greater than 5,000 hours.

In some embodiments, the semiconductor nanocrystal may be suspended or dissolved into an epoxy, an acrylate, or a silicone, materials traditionally used for LEDs, while utilizing a lens cap of a material of the present invention which affords a lifetime of over 5,000 hours. In another embodiment, the coated semiconductor nanocrystal may be suspended or dissolved into a matrix material of the present invention so as to allow a lifetime greater than 5,000 hours, and an epoxy, acrylate, or silicone lens cap of a traditional LED may be utilized. In a further embodiment, any combination of the two above embodiments may be utilized for maximum benefit.

In one embodiment of the present invention, the light emitted from an LED chip, e.g., an InGaN LED chip, may be between 440 nm to 480 nm. More specifically an InGaN chip may emit light between 450 nm and 470 nm and even more specifically at 460 nm. It is appreciated that unlike traditional phosphors, nanocrystals have a broadband absorption spectra and can therefore be excited by any light source having a shorter wavelength than the peak emission wavelength of the nanocrystals. It is appreciated that LED chips other than "blue" LEDs may be used such as violet and UV emitting chips (405-410 nm and 380-390 nm respectively) or green emitting LEDs. It is also appreciated that even shorter wavelength light sources and solid state light sources may be used in further embodiments.

Further, in one embodiment the active layer comprises a host matrix material which may be chosen from one of the following matrix materials; silicone, epoxy, amine modified epoxy acrylate, 1,6 Hexanediol diacrylate, and thermal or UV curable acrylates. The active layer may also contain semiconductor nanocrystals, which may be encased in glass. The purpose of the glass matrix material is two-fold. One advantage is that the size of the glass nanocrystal containing particles can be adjusted so that the scattering characteristics of the active layer may be optimized to maximize light output from the active layer, due to the scattering characteristics of glass. In addition, the glass host may protect the nanocrystals from exposure to oxygen, moisture, and chemical interaction with the matrix material, all of which contribute to the rapid degradation of the nanocrystals in LEDs of the prior art. It commonly understood in the art that using silicone as a matrix material helps protect the LED chips and extend the chip life. However difficulties in curing nanocrystal doped phosphor layers have prevented the use of silicone with nanocrystals in current commercial applications. Typical nanocrystals have surface ligands that interfere with the catalyst used to cure silicone. By replacing these ligands with a glass layer, the matrix can not only be cured but the nanocrystals themselves are more protected as well.

In a further embodiment the glass coated quantum dot phosphor layer may be used to create custom color LEDs for various lighting applications. Custom colors can be accomplished in one of two ways with this system. Quantum dots with various emission spectra may be formulated together into a glass host matrix to adjust the color composition of the phosphor layer. For example, to create a warm white LED, red emitting quantum dots combined with green emitting quantum dots may be glass coated together. This mixture can then be added to the host matrix material which is may be silicone and then deposited onto the LED chip. Alternatively a single color glass coated nanocrystal matrix can be produced and added in combination with other color glass coated nanocrystals as phosphors to produce custom colors within a matrix material. For example, green glass coated quantum dots can be added to red glass coated quantum dots in proper concentrations to achieve the desired CIE (International Commission on Illumination) color coordinates as defined by the CIE 1931 color space and added to a matrix material.

In a further embodiment the custom color LEDs described herein can be applied to a light bulb replacement fixture which includes at least one of a light emitting diode. As can be appreciated, this may consist of a single light emitting diode or a group of them. In one embodiment, small lighting applications such as warning lights in automotive lighting may only require a single light emitting diode. However, in another embodiment many light emitting diodes may be necessary. When more than one light emitting diode is needed, it should be understood that any number or grouping of the light emitting diodes may be utilized. In some embodiments, such as signage, a pattern may be formed using the light emitting diodes. The light emitting diode may be any now known or later developed light emitting diodes, which vary is size and color.

The light emitting diodes may further include a quantum dot coating on or above at least one of the light emitting diodes. The method of coating a light emitting diode is further described in commonly owned application (Ser. No. 12/579,829). It should be noted that the quantum dot coating alters the color of a light emitting diode by absorbing at least a portion of the light emitted by the LED and reemitting it, either replacing or combining with the underlying LED color. Depending on the color desired from the replacement fixture, one or more of the light emitting diodes may be coated, or all of the diodes may be coated. The type of quantum dot used may also vary.

In some embodiments the quantum dot may be selected from at least one of a group II-VI materials, III-V materials, IV-VI materials, I-III-VI materials or some combination thereof. It is understood that different sizes of each group of quantum dots results in different colors, and different group materials have different color ranges. A combination of at least one of sizes or groups of quantum dots can be combined to result in a custom color output from the light bulb replacement fixture.

Further, in some light replacement applications the system may comprise the light bulb replacement fixture further comprising a threaded screw which is electrically connected to the light emitting diode. In many embodiments, a light bulb replacement fixture may be required to be screwed into a light socket, such as incandescent replacements. In such an embodiment, the light emitting diode assembly is electrically connected to a screw structure. In an embodiment, the threaded screw fits into a traditional light bulb receiving fixture. It is understood that the size and power of the receiving fixture, or socket, may vary and any now known or later developed fixtures can be fitted with a replacement bulb fixture in accordance with embodiments of the invention.

In a further embodiment, the system may include an enclosure over the light emitting diodes. In some embodiments, the enclosure may be a traditional bulb. In other embodiments, enclosure may be a microlens array. It should be understood that there exist many light enclosures in the art that would be considered within the scope of the invention. It should also be noted that the quantum dot coating may be contained in the enclosure, as in the case when the quantum dot coating is above the light emitting diode.

In another embodiment, the system may comprise a lighting apparatus, such as a lamp. This may include desk lamps or in some embodiments, interior lighting fixtures such as ceiling lights. Further, in an embodiment the lighting apparatus may include at least one of a dial or a switch. The dial or switch may alter at least one of the input voltage, current, resistance, or power to at least one of the light emitting diodes so as to alter the color output of the at least one diode.

By varying voltage, current, or resistance, the light emitting diode may change color, which will alter the color output of the quantum dot coating as well. Turning one or more diode off will also result in an overall color change when more than one light emitting diode comprises the light fixture. Any combination of these effects may be utilized by moving the dial or switch to result in a dynamically colored light fixture. It should be understood that the dial or switch may be attached to a lighting apparatus, or it may be electrically connected, such as a switch on the wall which controls a ceiling light.

In some embodiments, a light emitting diode which may emit blue light can be altered to emit any of green, yellow, orange, red, white, or infrared light. An aqua colored light emitting diode can be altered to emit green light. A pink diode may be altered to emit purple. A green diode may be altered to emit yellow, orange, red, or infrared light. It is understood that this list is not an exhaustive list of color changes, but only a short list of examples of the colors achievable by altering an electrical property of the light replacement fixture.

Another embodiment may include a machine which may deposit quantum dots onto a light emitting diode. The machine may be programmable to deposit a specific type of quantum dot or size quantum dot in a specific concentration. In another embodiment the machine may deposit more than one type or size quantum dot in specific concentrations and in a specific ratio, so that nearly any color lighting fixture may be provided.

Below are provided several examples of LEDs and methods useful in practicing various embodiments of the invention.

EXAMPLE 1

Making a Custom White LED

Glass Coating Example 1:

Add 2 ml of quantum dots with a concentration of 15 mg/ml into a 15 ml centrifuge tube, add 10 ml methanol into the tube to precipitate the quantum dots out, and spin at ~4000 rpm for 3 minutes. Discard the supernatant and add 10 ml chloroform into the tube to reconstitute the dots. Add 100 μl of APS(3-aminopropyl-trimethoxysilane), and stir the solution at room temperature for at least 1 hour.

Add the above quantum dots/APS solution gradually into a 200 ml beaker containing approximately 100 ml of cyclohexane and stir rapidly. Add 2 ml Igepal-520, and stir for at least 30 minutes. Add 0.2 ml 127% ammonium hydroxide solution followed by 0.5 ml of tetraethoxysilane (TEOS), and stir the solution at room temperature for 15-20 hours.

After the reaction finished, add 20 ml anhydrous ethanol into the beaker and stir for 5 minutes, transfer the solution to 50 ml centrifuge tube, and spin at 4000 rpm for 5 minutes, and then discard the supernatant. Add 20 ml ethanol into the centrifuge tube to wash the precipitates, and spin at 4000 rpm briefly and discard the supernatant. Repeat the washing step one more time and dry the precipitate in an oven under vacuum at room temperature.

Glass Coating Example 2:

Add 2 ml of quantum dots with a concentration of 15 mg/ml into a 15 ml centrifuge tube, and add 10 ml methanol into this tube to precipitate the quantum dots, and spin at ~4000 rpm for 3 minutes. Discard the supernatants, and add 10 ml chloroform into the tube to reconstitute the dots. Add 100 μl of APS(3-aminopropyl-trimethoxysilane), and stir the solution at room temperature for at least 1 hour.

Add the above quantum dots solution gradually into a 200 ml beaker containing approximately 100 ml of silicone oil (polydimethylsiloxane, trimethylsiloxy terminated) and stir rapidly. Add 0.2 ml 27% ammonium hydroxide solution followed by 0.5 ml of tetraethoxysilane(TEOS), and stir the solution at room temperature for 15-20 hours. After the reaction is finished, add 20 ml methanol into the beaker and stir for 5 minutes, transfer the solution into 50 ml centrifuge tube, and spin at 4000 rpm for 5 minutes, and then discard the supernatant. Add 20 ml of choloroform into the centrifuge tube to wash the solid, and spin at 4000 rpm briefly, and discard the supernatant. Repeat the washing step one more time and dry the precipitate in an oven under vacuum at room temperature.

Adding Glass Coated Quantum Dots to Silicone Matrix Material:

Add glass coated nanocrystals to a matrix material such as silicone, epoxy, or thermal or UV-curable acrylate and stir/mix vigorously until a suspension occurs. The resulting mixture is then deposited onto a light emitting diode by means of pneumatic hand-held dispensing equipment, or fully or semi automated dispensing machinery.

1. The deposited material on the light emitting diode is cured by exposure to ultraviolet light or by exposure to thermal conditions consistent with the matrix material used and the manufacturers' suggested curing instructions.
2. Varying the concentration of glass coated nanocrystals in the matrix material will provide color alteration when a fixed volume is deposited onto a light emitting diode. Conversely, the concentration of glass coated nanocrystals in the matrix material can remain constant while altering the volume deposited onto the light emitting diode. Either of the above methods can be used to achieve a desired color result when the glass coated nanocrystals are excited and mixed with photons of a shorter wavelength.

The foregoing description of various aspects of the invention has been presented for the purpose of illustration and description. It is not intended to be exhaustive or to limit the invention to the precise form disclosed, and obviously, many modifications and variations are possible. Such variations and modifications that may be apparent to one skilled in the art are intended to be included within the scope of the present invention as defined by the accompanying claims.

What is claimed is:

1. A system comprising:

at least one light emitting diode;

an active layer consisting essentially of a matrix material and a plurality of quantum dots, wherein at least two of the plurality of quantum dots comprise a glass coating on a surface thereof; and a light bulb replacement fixture, wherein the active layer is at least one of the following: on the at least one light emitting diode or above the at least one light emitting diode.

2. The system of claim 1 wherein the matrix material comprises silicone.

3. The system of claim 1 comprising:

a lighting apparatus; and at least one of a dial or a switch on the lighting apparatus which alters at least one of the input voltage, current, resistance, or power to at least one of the light emitting diodes so as to alter the color output of the at least one diode.

4. The system of claim 1 wherein the plurality of quantum dot comprises a material selected from at least one of a group II-VI materials, III-V materials, IV-VI materials, I-III-VI materials or some combination thereof.

5. The system of claim 1, wherein the plurality of quantum dot comprises a semiconductor core with a metal layer.

6. The system of claim 1 wherein the light bulb replacement fixture comprises a threaded screw which is electrically connected to the light emitting diode.

7. The system of claim 6 wherein the threaded screw fits into a traditional light bulb receiving fixture.

8. The system of claim 1, further comprising an enclosure over the light emitting diode.

9. The system of claim 8 wherein the enclosure is a microlens array.

* * * * *